United States Patent [19]

Reinhold

[11] 4,146,410

[45] Mar. 27, 1979

[54] NON-FERRICYANIDE CHROMATE CONVERSION COATING FOR ALUMINUM SURFACES

[75] Inventor: Earl R. Reinhold, Levittown, Pa.

[73] Assignee: Amchem Products, Inc., Ambler, Pa.

[21] Appl. No.: 773,581

[22] Filed: Mar. 2, 1977

[51] Int. Cl.[2] ..... C23F 7/26

[52] U.S. Cl. ..... 148/6.2; 148/6.27

[58] Field of Search ..... 148/6.2, 6.27

[56] References Cited

U.S. PATENT DOCUMENTS

| | | | |
|---|---|---|---|
| 2,948,643 | 8/1960 | Pimbley | 148/6.2 |
| 3,113,051 | 12/1963 | Pimbley | 148/6.2 |
| 3,130,085 | 4/1964 | Otto | 148/6.2 |
| 3,404,043 | 10/1968 | Dell | 148/6.2 |
| 3,404,044 | 10/1968 | Russell | 148/6.2 |

*Primary Examiner*—Ralph S. Kendall

*Attorney, Agent, or Firm*—Robert C. Brown

[57] ABSTRACT

A composition, and method for using the composition in applying a conversion coating on aluminum and aluminum alloy surfaces, is disclosed. In the method of this invention an aluminum containing metal surface is contacted with a ferricyanide free aqueous acidic solution containing zinc, hexavalent chromium, fluoride, and molybdate ions. The coated metal surface shows inhanced resistance to corrosion and improved paint adhesion. The absence of ferricyanide in the composition promotes easier disposal of the spent solutions.

20 Claims, No Drawings

NON-FERRICYANIDE CHROMATE CONVERSION COATING FOR ALUMINUM SURFACES

BACKGROUND OF THE INVENTION

1. Field of the Invention

This invention relates to coating metal surfaces and more particularly to the coating of metal surfaces with solutions.

2. Description of the Prior Art

The prior art is replete with processes and solutions for performing chromate/fluoride conversion coatings on metal surfaces to enhance corrosion resistance and to promote paint adhesion. Typical of processes of this type are those described in United States patents Nos. 2,276,353, 2,471,909, 2,472,864, 2,796,370, 2,796,371, 2,507,966, 2,839,439, 2,843,513, 2,859,144, 2,868,679, 3,009,842. In spite of these advances problems remain unsolved while, at the same time, new problems due to advancing technology are created. For example, in a coil coating process for coating aluminum, commercial high speed lines are now in operation whereby it is possible to continuously process strips of metal at speeds of more than 1000 square feet per minute. Increasing the line speed promotes efficiency of the operation yet presents certain difficulties where chromate conversion coating solutions are employed because of the necessity of allowing a finite time period for the contacting of the metal surface with the solution. In an attempt to increase the rate of the chromate conversion coating step, additions of activating agents, known as bath accelerators, are sometimes made to the bath solutions. The purpose of adding the activating ions relates to their ability to increase the coating weight in a given period of time, e.g., coating efficiency of the bath. The result is a better final product. One activating substance which has met with some success is ferricyanide. See for example, U.S. Pat. Nos. 2,796,370, 2,796,371 and 2,988,465.

Although the ferricyanide activated chromate coating solutions have enjoyed appreciable commercial use, there are problems associated with their utility. For example, it has been found that the ferricyanide activated solution is subject to heat degradation at higher temperatures and also is relatively sensitive to changes in acidity. However, perhaps the most serious obstacle to the use of ferricyanide today relates to the disposal problem of the spent solutions because of the sometimes occurrence to free cyanide moieties.

At least one non-ferricyanide process for aluminum is known (U.S. Pat. No. 3,391,031) but this process requires the use of tungstanate material.

Today, as never before, there is an urgent need to develop coating compositions and methods for their use which are not only economical but will also result in a metal surface with enhanced corrosion and paint bonding characteristics - and which will achieve these benefits without detrimental environmental impact.

SUMMARY OF THE INVENTION

Briefly stated, this invention contemplates a conversion coating and a method for the use of this coating on aluminum containing surfaces. The coating solution comprises an aqueous acidic composition including the following ingredients:

(a) zinc (Zn) in an amount of from about 0.03 grams/-liter to about 3.0 grams/liter, preferably added as ZnO, (b) hexavalent chromium ($Cr^{+6}$) in an amount of from about 0.01 grams/liter to about 10.0 grams/-liter, preferably added as $CrO_3$, (c) fluoride (F) in the amount of from about 0.01 grams/liter to about 10.0 grams/liter, preferably added as $H_2SiF_6$, (d) molybdate (Mo) in an amount of from about 0.02 grams/liter to about 3.0 grams/liter, preferably added as 84% $MoO_3$, (e) acid ($H^+$) preferably added as $HNO_3$, to provide a pH of 0.0 to 5.5.

A preferred solution referred to hereinafter as the bath, contemplates, in grams per liter the following:

| Material | Grams/liter |
|---|---|
| $CrO_3$ | 2.00 |
| ZnO | 0.38 |
| $HNO_3$, 38° *Be'* | 3.40 (1.9 grams if 100% $HNO_3$) |
| $H_2SiF_6$ *as a* 23% aqueous solution | 4.56 |
| Molybdic acid as 84% $MoO_3$ | 0.475 |
| Water | balance |

In the practice of this invention the bath is most conveniently prepared from a concentrate in which, to produce the bath, the concentrate is diluted with water.

The preferred bath composition referred to above is most conveniently prepared by diluting with water a concentrate of the following composition:

| Material | Grams/liter |
|---|---|
| $CrO_3$ | 40.0 |
| ZnO | 7.6 |
| $HNO_3$, 38° Be' | 68.0 |
| $H_2SiF_6$ as a 23% aqueous solution | 91.2 |
| Molybdic acid, as a 84% $MoO_3$ | 9.5 |
| Water | balance |

In the method of this invention an aluminum containing surface is contacted utilizing conventional means such as spraying or dipping with the above described composition for a time sufficient to impart thereon a chromium conversion coating.

In a preferred embodiment of the method this invention, aluminum coil stock is sprayed with the composition of this invention in a continuous coil coating operation.

This invention may also be practiced by providing a concentrate containing the composition, known in the art as a "makeup" solution which, prior to actual use, is diluted with a sufficient quantity of water to provide a solution with ingredients in the previously referred to ranges.

It therefore is an object of the present invention to provide a method and composition which will allow a rapid formation of a chromate conversion coating on aluminum containing surfaces.

It is the further object of this invention to produce a method and composition which, when used on aluminum containing surfaces, imparts a highly corrosion resistant treatment to the metal.

Still another object of this invention is to provide an improved chromate coating solution which operates to promote paint receptivity on aluminum surfaces.

It is still another object of this invention to provide a method and composition which will achieve these foregoing beneficial objects even when used on a high speed aluminum coil coating operation.

Yet another object of this invention is to provide a ferricyanide-free chromate conversion coating solution and method for utilizing the solution.

These and other objects will be more readily apparent to those skilled in the art from the consideration of the following description and exemplary embodiments.

DETAILED DESCRIPTION OF INVENTION

In the following examples it should be understood that whenever the term aluminum is employed, it is meant to include aluminum and aluminum containing surfaces, e.g. alloys.

Percent means by weight unless otherwise indicated.

In an example of a preferred embodiment, a concentrate was prepared utilizing commercially available materials, by combining the materials to form the concentrate. The concentrate was prepared from the following ingredients in the amount specified:

| Material | Grams/liter |
|---|---|
| $CrO_3$ | 40.0 |
| ZnO | 7.6 |
| $HNO_3$, 38° Be' | 68.0 |
| $H_2SiF_6$ as a 23% solution | 91.2 |
| Molybdic acid as 84% $MoO_3$ | 9.5 |
| Water | balance |

From this concentrate a bath is prepared by diluting the concentrate with water to make a 5% (by volume) solution.

The final solution pH was about 1.5.

A five stage commercial aluminum coil coating line consisting of four immersion tanks followed by a fresh water spray final rinse was made operational. The line speed was adjusted to vary to between no more than about 25 to 100 feet per minute. Utilizing this set-up aluminum coil stock of various alloy compositions, including the type commonly known as 3003, 3105, 5005, 5052 and "utility stock" were treated as follows.

The coil line was started and the coil was first cleaned in both stages 1 and 2 by immersion in an acidic metal cleaning solution which is well known in the art and which form no part of this invention. Following the two cleaning stages the coil was processed in stage 3 which was an immersion water rinse stage. The clean coil then proceeded to stage 4 where it was contacted, by immersion, with the above described bath solution of this invention for various time periods of from about 10 to about 30 seconds. The pH of the bath solution was maintained at about 1.5 and the bath temperature was kept at approximately 120° F. Following treatment with the composition of this invention, the aluminum coil was subjected to a final water spray rinse after which the metal was dried and painted.

Analysis of the appearance and properties of metal treated in the above fashion indicated that the final product was in all ways comparable to metal produced by prior art ferricyanide containing processes.

EXAMPLE I

In example I, six sets of aluminum panels made from 3003 alloy were subjected to the following treatment sequence:

| Sequential Steps | Process Step |
|---|---|
| Stage 1 | Alkaline cleaning step |
| Stage 2 | Tap water rinse step |
| Stage 3 | Treatment at about 100° F. with bath composition. |
| Stage 4 | Tap water rinse step |

Following stage 4 the sets of panels treated in the above described manner were painted and subsequently tested for performance. The results are set forth in Tables I and II.

TABLE I

| 1 Panel Designation | 2 Panel Composition | Bath Composition 3 $Zn^{++}$ g/l | 4 $Cr^{+6}$ g/l | 5 Free acid as equiv. ($10^{-4}$) | 6 Coating weight mg/ft$^2$ | 7 Spray time in seconds |
|---|---|---|---|---|---|---|
| A-1 | 3003 alloy | 0.0 | 0.9 | 0.9 | 7.2 | 15 |
| A-2 | 3003 alloy | o.1 | 0.9 | 0.8 | 24.3 | 15 |
| A-3 | 3003 alloy | 0.2 | 0.9 | 1.0 | 31.2 | 15 |
| A-4 | 3003 alloy | 0.3 | 0.9 | 0.9 | 39.6 | 15 |
| A-5 | 3003 alloy | 0.4 | 0.9 | 0.9 | 37.8 | 15 |
| A-6 | 3003 alloy | 0.5 | 0.9 | 0.9 | 27.3 | 15 |
| A-7 (standard) | 3003 alloy | ferricyanide treated | 0.6 | — | 14.4 | 5 |
| A-8 | 3003 alloy | used as blank (cleaned only) | | | 0.3 | not sprayed |
| A-9 (standard) | 3003 alloy | ferricyanide treated | 0.6 | — | 40.5 | 15 |

In the left column, reading from top to bottom A-1, 2, 3, etc. indicate panels plus duplicates, so that the figures given for results are averages of at least two trials. A-7 and A-9, used as comparison reference panels, designate panels treated according to the method of U.S. Pat. No. 2,988,465. These panels are standard prior art ferricyanide treated panels. Panel A-8, also used as a reference panel, was cleaned in a similar manner as the other test panels but received no conversion coating of any type and thus performs as a blank.

In Table I, reading from left to right, panel designation indicates by number the nine panels utilized in the tests. Panel composition indicates the type of aluminum alloy utilized in the test. The bath compositions shown in columns 3 and 4 indicate, in grams/liter, the amount of each denominated material, for A-1 through A-6 calculated for the ion indicated.

The six sets of panels (A-1 through A-6) prepared in accordance with Example II were prepared with varying amounts of zinc to demonstrate the accelerating effect of various levels of zinc in producing coatings on the panels treated in accordance with the teachings of this invention.

Column 5 figures represent a measure of the free acid content of the bath which was determined by titrating a one milliliter bath sample with 0.1 N NaOH to a mixed methyl red and bromocresyl green end point. The numbers in column 5 indicate the number of equivalents of base needed to neutralize the acid present.

Column 6 shows the final coating weight achieved by the bath and process of this invention and the prior art standards. The coating weight in milligrams/square foot was determined by weighing the panels after the conversion treatment and then stripping the coated panels by using a nitric acid solution and reweighing the stripped panels. The difference in weight was attributed to the coating. Column 6 demonstrates that the coating weight (as a measurement of the suitability of the bath for the purpose of achieving improved paint bonding) which is achievable with the composition and method of this invention compares favorably with the prior art.

Column 7 indicates spray time in seconds of the stage 3 conversion coating treatment step.

Panels were rated both numerically and descriptively.

Numerical rating of the panels was done visually on a scale ranging from 1 to 10 with 10 representing the best result.

Description such as "slight, " "moderate," etc, indicate that the loss of paint was observed to be "slight," "moderate" etc.

As can readily be seen from the results in Table II, panels coated in accordance with the composition and method of this invention give results overall which are as good as prior art ferricyanide activated solutions.

There are many variations which may be practiced within the scope of this invention. As has been pointed out previously, the process and composition are useful in aluminum containing surfaces by which is meant to include aluminum alloys of all types.

TABLE II

| Identification and Type Metal | Zinc content of bath g/l | Acid Salt Spray 5% at 95° F. 500 Hours | | | | Acid Salt Spray 5% at 95° F. 1000 Hours | | | |
|---|---|---|---|---|---|---|---|---|---|
| | | Untaped Area | | Taped Area | | Untaped Area | | Taped Area | |
| | | Scribed | Unscribed | Scribed | Unscribed | Scribed | Unscribed | Scribed | Unscribed |
| 1 | 2 | 3 | 4 | 5 | 6 | 7 | 8 | 9 | 10 |
| A-1 | 0 | slight | 7.0 | slight | Very slight | Moderate | 3.0 | Moderate | Moderate |
| A-2 | 0.10 | Very slight | 10 | Very slight | Very slight | Slight | 3.0 | Slight | Moderate |
| A-3 | 0.20 | Very slight | 10 | Very slight | Very slight | Moderate | 3.0 | Moderate | Moderate |
| A-4 | 0.30 | Very slight | 10 | Very slight | 10 | Moderate | 3.0 | Moderate | Slight |
| A-5 | 0.40 | Very slight | 10 | Very slight | 10 | Moderate | 3.0 | Moderate | Moderate |
| A-6 | 0.50 | Very slight | 10 | Very slight | 10 | Moderate | 3.0 | Moderate | Moderate |
| A-7 | — | Slight | 10 | Slight | 10 | Moderate | 3.0 | Moderate | Moderate |
| A-8 | — | Slight | 7.0 | Slight | Slight | Heavy | 2.0 | Moderate | Moderate |
| A-9 | — | Very slight | 10 | Very slight | 10 | Moderate | 3.0 | Moderate | Moderate |

Table II contains data collected from the testing of the panels described in connection with Table I to ascertain the durability of panels prepared in accordance with the teachings of this invention after they are exposed to test conditions which simulate actual use.

In Table II, column 1 indicates the panel designation A-1 through A-9 which are panels whose composition and treatment are the same as that heretofore described.

Column 2 denotes the amount of zinc in the coating composition in grams per liter.

Columns 3 through 10 indicate results from a standard acid/salt spray of the particular panel in taped and untaped areas for both a scribed and unscribed portion of the panel. This particular test refers to a test as described in detail in the *American Society of Testing Materials Bulletin* number ASTM B-287.

In performing the aforementioned standard test the panels to be tested, after being treated by the composition and method of this invention together with standards and blank, are then coated with paint. The particular paint system utilized in this test is known as PPG Duracron 630 and is manufactured by Pittsburgh Plate Glass. This paint is an acrylic paint applied and baked and is used as a standard for this purpose in this test.

By taped and untaped is meant to indicate that part of the panel is covered with pressure sensitive tape and removed after the test to remove non-adherent paint and the purpose is to indicate the ability of the treated and painted panel to withstand a corrosive atmosphere.

By scribed is meant to indicate whether the panel was rated on an area immediately adjacent an area which had been scribed to cut through the paint to the bare metal. This test measures the ability of the painted metal to resist errosion after damage. Unscribed indicates an area on the panel other than a scribed area.

Column 7 through 10 give data for an acid/salt spray test performed in the same manner as that described for columns 3–6, but in which the exposure of the panel to the acid/salt spray is increased from 500 to 1000 hours.

The various constituents of the bath of this solution may range within the limits described.

Zinc is essential to achieve a proper coating weight. Zinc acts as the accelerator thus obviating the need for ferricyanide.

Nitrate is not essential to coating formation. However, it is necessary to maintain the acidity of the bath and for this purpose nitric acid is preferred. Other acids such as chromic would increase the chromate ion retarding coating formation. Hydrochloric, sulfuric and phosphoric acids are deleterious to the bath. Thus while any acid which will lower pH and not adversely affect the bath are theoretically possible, nitric acid is preferred.

In the practice of this invention the bath must be maintained in the acid range. A pH of 0 to 5.5 is operable with a preferred pH range of 1.0 to 2.5.

Variations are also permissable in the particular compositions which are utilized to supply the necessary ions required to practice this invention. For example, many different fluorides may be utilized in place of fluoro silicate shown. Other complex metal fluorides in either acid or salt form, such as for example, fluoborates, fluotitanates, fluostannates, fluozirconates or others as is well known in the art may be substituted. Hydrofluoride acid and salts, such as sodium, potassium or ammonium fluoride are also acceptable.

The molybdate ions may be added as molybdic acid, sodium molybdate, ammonium molybdate or many of the other numerous forms of molybdate available on the market today. For example, molybdic acid is commercially sold as 84% $MoO_3$ at the present time, which form is suitable for this invention.

The chrome must be hexavalent chrome and any source of this ion is acceptable.

The bath will normally require replenishment during operation and replenishment may be accomplished by ascertaining the deficiency by methods well known in the art and simply adding the necessary material.

While examples have been given of an appropriate time of exposure of the metal to the solution to achieve the desired effect, it should be appreciated that widespread variation is possible depending on equipment variations and method of coating employed. Appropriate contacting time periods are known and those skilled in the art will have no difficulty in ascertaining the proper contact time for their particular work piece and equipment.

The time and the temperature of the process are related inversely. That is, the hotter the temperature, in general, the shorter the time period needed to achieve coating. It has been found that good results can be achieved at a bath temperature of 120° F. and the coating time at this temperature varies with equipment but 10 seconds is representative. For economy the bath temperature utilized is normally the ambient (room) temperature but the process may be run at elevated temperatures of at least as high as 160° F.

As has also been pointed out previously, this process and composition, while most useful in a coil coating operation, works equally well where individual metal work pieces are being treated. Furthermore, there is no limitation on the type of equipment which may be utilized in the application of the solution of this invention. Method steps may include, for example, spraying, dipping or flow coating (flowing the solution over the surface of the metal) and all are satisfactory methods of contacting the metal surface with the bath.

Variations in the coating weight, depending upon the amount of constituents, especially zinc, has been demonstrated by the foregoing Tables and Graphs. Although as a general rule an increase in coating weight is desirable, the economics of the situation, or the end use to which the metal is to be put, may dictate variations along this line. This too is well known in the art.

While the foregoing examples have included a precleaning step, which is necessary to insure uniform results, it does not form a necessary part of this invention and it is often possible to satisfactorily coat metal without several precleaning steps, depending upon the surface condition of the material prior to the coating step.

Postcoating steps prior to painting may also be employed such as application of acidulated aqueous solutions which may contain chromates, etc. known in the art as chromate rinses. However, these final rinses are entirely optional.

The composition and method of this invention provide many advantages. Chief among these, as has been pointed out, is the ability to eliminate the need to use ferricyanide as the bath accelerator.

The composition and process of this invention are economical in that they provide an end product equal in every way to the prior art processes. However, this invention makes use of relatively inexpensive materials including obviating the need for the use of tungstanate, a costly material.

The composition and method of this invention are totally compatible with currently available equipment and techniques.

While the invention has been illustrated and described in detail, such description is not exhaustive of possible permutations encompassed within the scope of this disclosure. It is not intended for the invention to be limited to only those specific embodiments disclosed but rather only by a reasonable interpretation of the appended claims.

What is claimed is:

1. An acidic aqueous composition suitable to impart a chromate conversion coating on aluminum containing surfaces consisting essentially of:

(a) zinc in an amount from about 0.03 to about 3.0 grams per liter calculated as zinc (Zn), (b) hexavalent chromium in an amount from about 0.01 to about 10.0 grams per liter calculated as chromium ($Cr^{+6}$), (c) fluorine in an amount from about 0.01 to about 10.0 grams per liter calculated as fluoride ($F^-$), (d) molybdate in an amount from about 0.02 to about 3.0 grams per liter calculated as molybdenum (Mo).

2. A composition according to claim 1 in which (a) zinc is added as ZnO, (b) hexavalent chromium is added as $CrO_3$, (c) fluorine is added as a 23% aqueous solution of $H_2SiF_6$, (d) molybdate is added as 84% molybdic acid and which composition contains additionally nitric acid.

3. A composition according to claim 1 in which (a) zinc is added as ZnO in about 0.38 grams per liter, (b) hexavalent chromium is added as $CrO_3$ in about 2.00 grams per liter, (c) fluorine is added as a 23% aqueous solution of $H_2SiF_6$ in about 4.56 grams per liter, (d) molybdate is added as 84% molybdic acid in about 0.475 grams per liter and which composition contains additionally nitric acid (100%) present in about 1.9 grams per liter.

4. The composition according to claim 1 in which the composition is prepared from a concentrate by diluting the concentrate with water to produce the composition.

5. The composition according to claim 2 in which the composition is prepared from a concentrate by diluting the concentrate with water to produce the composition.

6. The composition according to claim 3 in which the composition is prepared from a concentrate by diluting the concentrate with water to produce the composition.

7. The composition according to claim 1 in which fluorine is added as a member selected from the group consisting of the complex metal fluoride acids and salts thereof.

8. The composition according to claim 1 in which fluoride is added as a member selected from the group consisting of hydrogen fluoride and salts thereof.

9. A method of producing a chromate conversion coating on an aluminum containing surface by contacting the surface with an acidic solution consisting essentially of:

(a) zinc in an amount from about 0.03 to about 3.0 grams per liter calculated as zinc (Zn), (b) hexavalent chromium in an amount from about 0.01 to about 10.0 grams per liter calculated as chromium ($Cr^{+6}$), (c) fluorine in an amount about 0.01 to about 10.0 grams per liter calculated as fluoride ($F^-$), (d) molybdate in an amount from about 0.02 to about 3.0 grams per liter calculated as molybdenum (Mo).

10. The method according to claim 9 in which in the solution (a) zinc is added as ZnO, (b) hexavalent chromium is added as $CrO_3$, (c) fluorine is added as a 23% aqueous solution of $H_2SiF_6$, (d) molybdate is added as 84% molybdic acid and which composition contains additionally nitric acid.

11. The method according to claim 9 in which in the solution (a) zinc is added as ZnO in about 0.38 grams per liter, (b) hexavalent chromium is added as $CrO_3$ in about 2.00 grams per liter, (c) fluorine is added as a 23% aqueous solution of $H_2SiF_6$ in about 4.56 grams per liter, (d) molybdate is added as 84% molybdic acid in about 0.475 grams per liter and which composition contains additionally nitric acid (100%) present in about 1.9 grams per liter.

12. The method according to claim 9 in which the aluminum surface is supplied from a coil coating operation.

13. The method according to claim 9 in which the contacting is by immersion.

14. The method according to claim 9 in which the contacting is by spraying.

15. The method according to claim 9 in which the temperature of the solution is no higher than about 160° F.

16. A method of producing a chromate conversion coating on aluminum containing surfaces including:

(a) supplying an aqueous concentrate consisting essentially of i. about 7 grams per liter of ZnO, ii. about 40 grams per liter $CrO_3$, iii. about 68 grams per liter of nitric acid, iv. about 90 grams per liter of an approximately 23% aqueous solution of $H_2SiF_6$, and v. about 10 grams per liter of an approximately 84% aqueous solution of molybdic acid, (b) diluting said concentrate with water to produce a 5% (by volume) solution; and (c) contacting said solution with an aluminum containing surface for a time sufficient to impart thereon a chrome conversion coating.

17. The composition according to claim 1 wherein the pH ranges from 0 to 5.5.

18. The composition according to claim 1 wherein the pH ranges from 1.0 to 2.5.

19. The method according to claim 9 wherein the pH ranges from 0 to 5.5.

20. The method according to claim 9 wherein the pH ranges from 1.0 to 2.5.

* * * * *